United States Patent [19]

Kwan

[11] 4,407,128

[45] Oct. 4, 1983

[54] FUEL BURNERS

[75] Inventor: William C. T. Kwan, Derby, England

[73] Assignee: Rolls-Royce Limited, London, England

[21] Appl. No.: 186,267

[22] Filed: Sep. 11, 1980

[30] Foreign Application Priority Data

Sep. 13, 1979 [GB] United Kingdom ..... 7931778

[51] Int. Cl.[3] ..... F02C 7/22

[52] U.S. Cl. ..... 60/737; 60/748; 239/402; 239/404; 239/406

[58] Field of Search ..... 60/737, 748; 239/402, 239/402.5, 403, 404, 405, 406

[56] References Cited

U.S. PATENT DOCUMENTS

| | | | |
|---|---|---|---|
| 3,483,701 | 12/1969 | Harvey et al. | 60/737 |
| 3,853,273 | 12/1974 | Bahr et al. | 60/748 |
| 3,980,233 | 9/1976 | Simmons et al. | 60/748 |
| 4,092,826 | 6/1978 | Pask | 60/748 |
| 4,216,652 | 8/1980 | Herman et al. | 60/748 |
| 4,222,243 | 9/1980 | Mobsby | 60/748 |
| 4,271,675 | 6/1981 | Jones et al. | 60/748 |
| 4,321,794 | 3/1982 | Etheridge | 60/748 |

*Primary Examiner*—Carlton R. Croyle
*Assistant Examiner*—Jeffrey A. Simenauer
*Attorney, Agent, or Firm*—Cushman, Darby & Cushman

[57] ABSTRACT

A gas turbine engine fuel burner comprises a convergent/divergent flow passage which receives a flow of swirling fuel and air upstream of the passage throat. The fuel and air mixture passes through the throat and is entrained into a further mass of swirling air which enters the passage through air swirlers in the wall of the divergent portion of the passage.

The invention is intended to promote good fuel and air mixing, fine atomization and a reduction in carbon deposition on the burner.

10 Claims, 12 Drawing Figures

FUEL BURNERS

This invention relates to gas turbine engine fuel burners.

The invention seeks to provide an improved form of fuel burner in which a good fuel pattern distribution is achieved, mixing of fuel and air and the atomization of the fuel is improved and the formation of carbon on the burner, more particularly the burner pintle is either eliminated or substantially reduced.

Accordingly, the present invention provides a gas turbine engine fuel burner comprising a fuel feed arm, a fuel inlet manifold arranged to receive fuel from the fuel feed arm, a flow passage having convergent and divergent portions and a throat located between said portions, the flow passage upstream of the throat being arranged to receive fuel from said manifold through fuel swirling means and compressed air through air swirling means, and the divergent portion having further air swirling means arranged to receive compressed air, the mixture of fuel and air issuing from the throat being entrained by the swirling air issuing from said further air swirling means.

The fuel and compressed air entering the flow passage upstream of the convergent portion may either be arranged to swirl in same direction or opposite directions to each other and the two air swirling means can also be arranged to swirl the compressed air in the same direction as each other on the opposite direction to each other.

The flow passage may have a projecting lip which is arranged to direct fuel from the fuel swirling means into the swirling mass of air. The lip may be located upstream of the air swirling means and extend into the flow passage thereof or it may be located downstream of the air swirling means and extend into the flow passage from the outer surface.

The manifold may be defined by a ring having an annular recess, the ring being located in an aperture at the end of the fuel feed arm and an intermediate member in which are formed the fuel swirling means and the further air swirling means the flow passage may be defined by the co-operation between the intermediate member and the inner member which is provided with the air swirling means. The fuel and air swirling means may comprise holes, slots or vanes or any combination thereof arranged tangentially to the flow passage.

Figure 1:
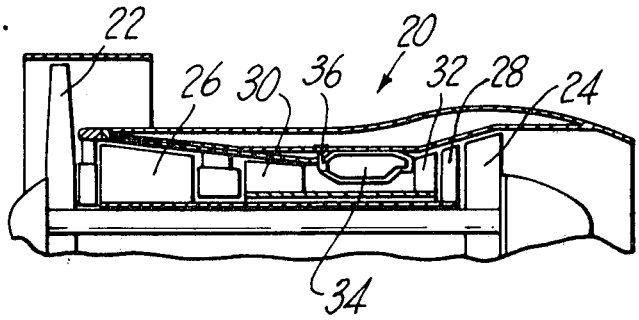
Figure 2:
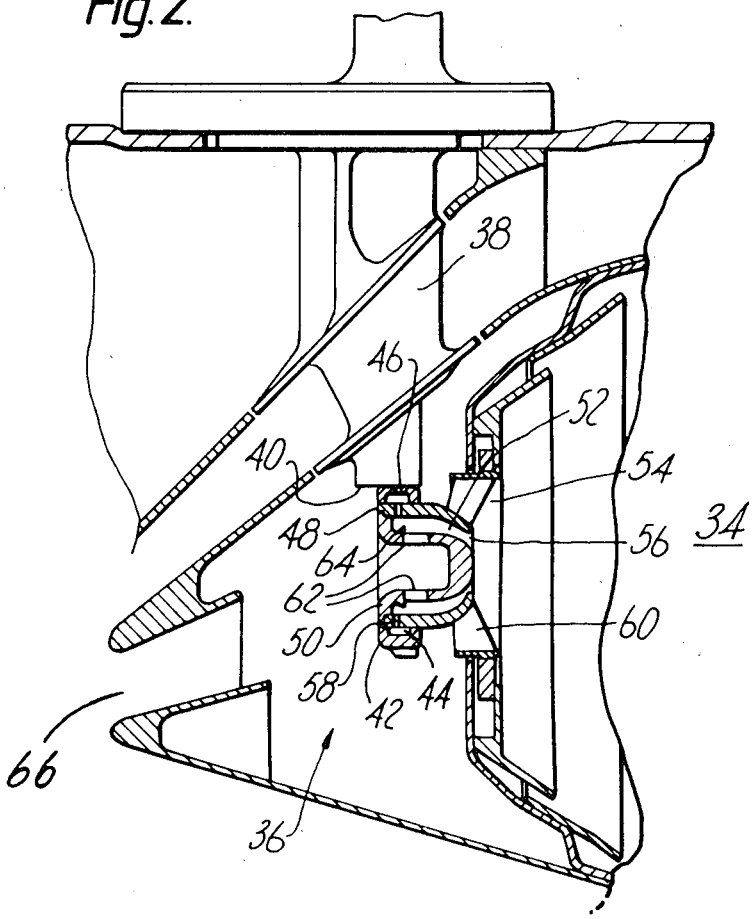
Figure 3:
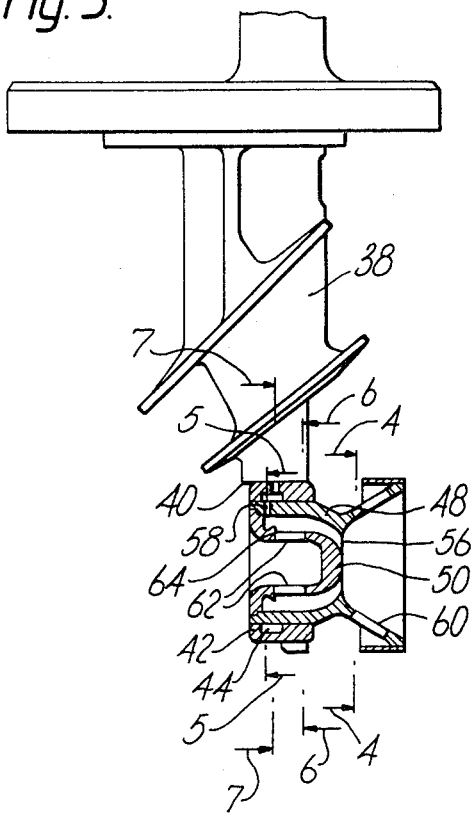
Figure 4:
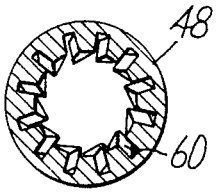
Figure 5:
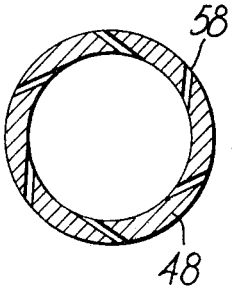
Figure 6:
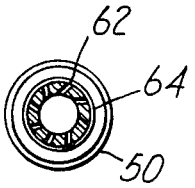
Figure 7:
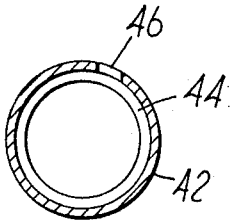
Figure 8:
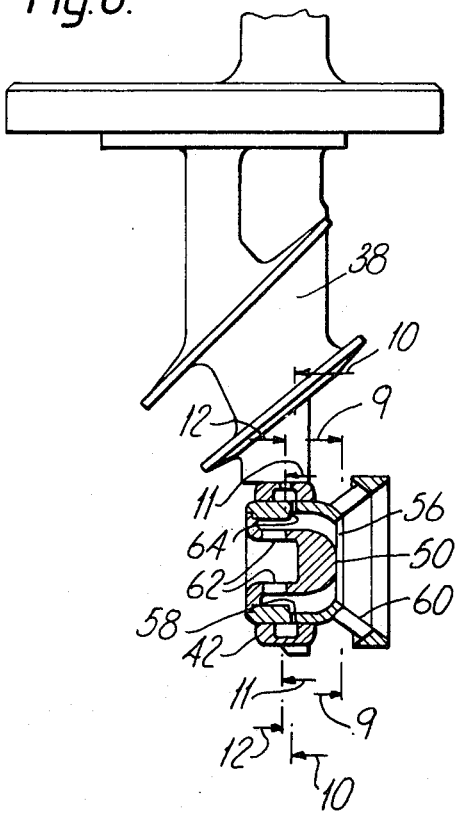
Figure 9:
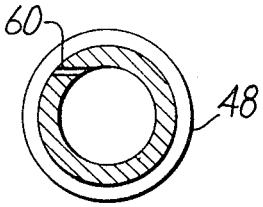
Figure 10:
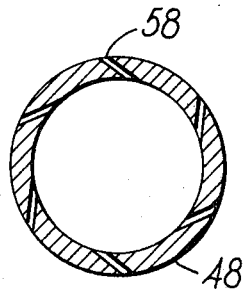
Figure 11:
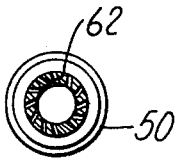
Figure 12:
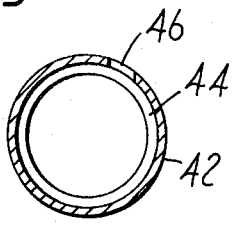

The present invention will now be more particularly described with reference to the accompanying drawings in which:

FIG. 1 shows diagrammatically a gas turbine engine incorporating one form of fuel burner according to the present invention, FIG. 2 shows in detail the fuel burner referred to in FIG. 1, FIG. 3 shows a further form of a fuel burner according to the invention, FIG. 4 is a part-section on line 4—4 in FIG. 3, FIG. 5 is a part-section on line 5—5 in FIG. 3, FIG. 6 is a part-section on line 6—6 in FIG. 3, FIG. 7 is a part-section on line 7—7 in FIG. 3, FIG. 8 shows another form of a fuel burner according to the present invention, FIG. 9 is a part-section on line 9—9 in FIG. 8, FIG. 10 is a part-section on line 10—10 in FIG. 9, FIG. 11 is a part-section on line 11—11 in FIG. 9, FIG. 12 is a part-section on line 12—12 on FIG. 8.

In FIG. 1 there is shown a typical lay-out of a high by-pass ratio gas turbine 20 having a fan 22 and associated fan driving turbine 24, an intermediate pressure compressor 26 and associated turbine 28, a high pressure compressor 30 and associated turbine 32 and an annular combustion chamber 34 having a number of equi-spaced fuel burners 36, shown in detail in FIG. 2.

Each fuel burner 36 comprises a fuel feed arm 38 terminating in an aperture 40 in which a ring 42 is located and secured, the ring 42 forming in part a fuel manifold 44 having a tangential fuel inlet 46.

An assembly comprising an intermediate member 48 and an inner member or pintle 50 is secured and located within the ring 42, the intermediate member in combination with the ring, defining the fuel manifold.

The intermediate and inner members between them define a flow passage having a convergent portion 52, a divergent portion 54 and a throat 56, the member 48 having a number of equi-spaced fuel inlets 58 upstream of the convergent portion and air swirling vanes 60 in the divergent portion 54.

The inner member 50 has air swirling means which comprise a number of equi-spaced tangential slots 62 and a lip 64 which projects into the flow passage from the inner surface of the passage.

In operation, fuel from the fuel feed arm 38 flows into the fuel manifold 44 through the inlet 46 and thence into the flow passage upstream of the convergent portion 52, through the fuel swirling inlets 58. Compressed air from the high pressure compressor 30 flows via an annular inlet 66 o the combustion chamber 34, to the air swirlers 60 and 62 of each burner 36 forming a total head feed. The swirling fuel in the flow passage is directed by the lip 64 to flow towards the outer surface and is mixed with the air flowing in through the slots 62. The swirling mixture is controlled by the throat and when it passes the sharp orifice, good atomization with fine droplet size is obtained. The atomized fuel and air mixture is then entrained by the swirling air from the vanes 60 and swirls outwardly into the combustion chamber and gives further atomization.

A proportion of the swirling fuel and air mixture washes over the dome shaped downstream end of the pintle 50 and prevents or at least reduces carbon formation on the pintle.

The embodiment of the invention as shown in FIGS. 3 to 7 inclusive has many similarities with that shown in FIG. 2, the notable difference being the construction of the air swirlers 60 which in this instance are in the form of slots machined in the downstream end of the intermediate member 48, as shown in detail in FIG. 4.

FIG. 5 shows the fuel swirling inlets 58 in the intermediate member 48, FIG. 6 shows the air swirler inlets 62 and lip 64 of the inner member 50 and FIG. 7 shows the tangential fuel inlet 46 in the ring 42, leading into the fuel manifold 44.

The manner of operation of this fuel burner corresponds to that described with reference to FIG. 2.

The embodiment of the invention shown in FIGS. 8 to 12 inclusive has many similarities to the previous embodiments, except that the lip 64 has been removed from the inner surface of the flow passage and a lip 64 has been provided on the outer surface of the passage downstream of the air swirler inlets 62. Also the air swirler inlets 60 are in the form of tangential slots as shown in FIG. 9, although only one slot is illustrated, a plurality of equi-spaced slots are provided in practice.

FIGS. 10, 11 and 12 corrspond with FIGS. 5, 6 and 7, although it will be noted that more air swirler inlets 62 are provided, see FIG. 11.

This embodiment functions in a similar manner to the previous two embodiments except that the swirling air from the inlets 62 entrains the incoming fuel from the lip 64 which now projects into the flow passage from the outer surface of the passage.

The fuel and air swirling inlets 58, 60 and 62 respectively may be arranged to swirl fuel and air respectively either all in the same direction or one or two of the inlets 58, 60 and 62 may be arranged to swirl their respective fluids in a direction opposite to the fluid flowing through the remaining inlet.

I claim:

1. A gas turbine fuel burner comprising a fuel manifold arranged to receive fuel from a fuel feed arm, a flow passage having a surrounding outer surface, the flow passage comprising an annular converging section supplied with air, and fuel from the fuel manifold for mixing of fuel and air and having a diverging section supplied with further air and a throat located therebetween, said flow passage being defined in part at its outer surface by an annular intermediate member, said annular intermediate member having a portion converging to said throat and a portion diverging downstream of said throat, said annular converging section of said flow passage being defined between the converging portion of said annular intermediate member and a hollow inner member, said hollow member having a closed downstream end and an open upstream end, the downstream end of said inner member being located at said throat of said flow passage, first radial swirling means in said inner member for supplying air to said annular converging section of said flow passage, second axial swirling means in said annular intermediate member downstream of said throat for supplying air to said diverging section of said flow passage, and fuel swirling means in said annular intermediate member upstream of said throat for supplying fuel from said fuel manifold to said annular converging section of said flow passage.

2. A fuel burner as claimed in claim 1 in which the fuel swirling means is arranged to swirl the fuel in the same direction as the air is swirled by the first air swirling means.

3. A fuel burner as claimed in claim 1 in which the fuel swirling means is arranged to swirl the fuel in the opposite direction to that in which the air swirled by the first air swirling means.

4. A fuel burner as claimed in claim 1 in which the first air swirling means is arranged to swirl the air in the same direction as that in which the air is swirled by the second air swirling means.

5. A fuel burner as claimed in claim 1 in which the first and second air swirling means arranged to swirl their respective airflows in directions opposite to each other.

6. A fuel burner as claimed in claim 1 in which the fuel swirling means are located downstream of a lip extending from the annular intermediate member into the annular converging section of the flow passage.

7. A fuel burner as claimed in claim 1 in which the fuel manifold comprises a ring located at the end of the fuel feed arm and the intermediate member, said ring having a recess forming said fuel manifold and a tangential fuel inlet in communication with the fuel feed arm.

8. A fuel burner as claimed in claim 7 in which the flow passage is defined by the intermediate member and the inner member, the intermediate member being provided with the fuel swirling means and the second air swirling means, the inner member being provided with the first air swirling means.

9. A fuel burner as claimed in claim 1 in which the fuel first air swirling means each comprise a ring of equi-spaced apertures, the axes of which are arranged tangentially to the flow passage.

10. A fuel burner as claimed in claim 9 in which the apertures are defined by machined openings in the intermedaite and inner members.

* * * * *